United States Patent [19]

Rubbo et al.

[11] Patent Number: 4,502,444

[45] Date of Patent: Mar. 5, 1985

[54] AIR-FUEL RATIO CONTROLLER

[75] Inventors: John T. Rubbo, South Amboy; Kenneth R. Burns, Westfield; Ronald M. Heck, Frenchtown; John J. Early, Perth Amboy, all of N.J.

[73] Assignee: Engelhard Corporation, Iselin, N.J.

[21] Appl. No.: 515,695

[22] Filed: Jul. 19, 1983

[51] Int. Cl.[3] ..... F02B 3/00

[52] U.S. Cl. ..... 123/440; 123/489; 72/23

[58] Field of Search ..... 123/489, 440; 73/23

[56] References Cited

U.S. PATENT DOCUMENTS

| | | | |
|---|---|---|---|
| 3,984,976 | 10/1976 | Nagai | 123/440 |
| 4,019,470 | 4/1977 | Asano | 123/440 |
| 4,120,269 | 10/1978 | Fujishiro | 123/440 |
| 4,131,089 | 12/1978 | Fujishiro | 123/440 |
| 4,140,086 | 2/1979 | Schnurle | 123/440 |
| 4,142,482 | 3/1979 | Asano | 123/440 |
| 4,167,925 | 9/1979 | Hosaka | 123/440 |
| 4,170,965 | 10/1979 | Aono | 123/440 |
| 4,203,394 | 5/1980 | Aono | 123/440 |
| 4,237,829 | 12/1980 | Asano | 123/440 |
| 4,237,839 | 12/1980 | Ueno | 123/489 |
| 4,278,060 | 7/1981 | Isobe | 123/440 |
| 4,306,444 | 12/1981 | Hattori | 123/489 |

*Primary Examiner*—Ronald B. Cox

[57] ABSTRACT

A system for the control of the air-fuel ratio in an internal combustion engine incorporates an electronic control unit, a sensor of exhaust emissions and a valve for metering fuel with air to control the air-fuel ratio. The electronic control unit provides for the comparison of successive measurements of the sensor output voltage under conditions wherein the fuel valve is being operated for ever increasing richness or leaness until such time as the differential measurement drops below a predetermined amount. An offset voltage is then subtracted from or added to this voltage to calculate an operating set point voltage. Thereby, the system's accuracy is maintained through the compensation for changed sensor characteristics with aging.

20 Claims, 6 Drawing Figures

OXYGEN SENSOR OUTPUT VS. AIR FUEL RATIO FOR AN ILLUSTRATIVE ENGINE

OXYGEN SENSOR OUTPUT VS. AIR FUEL RATIO FOR AN ILLUSTRATIVE ENGINE $T_0$
$T_2$
$T_{10}$
TIME
START 1.
OFF
VACUUM SWITCH 2.
STOP
RUN
2 MIN. TIME DELAY 3.
SENSOR TEMPERATURE 4.
MOTOR CONTROL VALVE 5.
OPEN
CLOSED
SET POINT
SRV
SPV
SET POINT
SRV
SPV
SOLENOID FUEL VALVE 6.
CLOSED
CLOSE
OPEN (CALIBRATE CYCLE INITIATED)
CALIBRATION 7.
CALIBRATE
START
RECALIBRATE
START
24 HRS.
ECU 8.
OFF
ON
OFF

AIR-FUEL RATIO CONTROLLER

BACKGROUND OF THE INVENTION

This invention relates to engines powered by the burning of fuel in air or other oxidant and, more particularly, to the electronic control of the air-fuel ratio.

The internal combustion engine is commonly used for driving a large variety of vehicles and machinery. The engines may burn hydrocarbon fuels in gaseous or liquid form. The products of combustion, water, unburned hydrocarbons, oxides of carbon and oxides of nitrogen, vary in their respective concentration depending in part upon the air-fuel ratio at the input of the engine. Also, the efficiency of the engine is dependent on the air-fuel ratio. Accordingly, in many situations it is important to control the air-fuel ratio as a function of at least one output gas such as oxygen which has not combined with the fuel so as to provide for desired levels of engine emissions and efficiency.

One form of electronic control commonly in use comprises a feedback circuit in which an air-fuel control mixture system or means such as a mixing valve is operated in response to the concentration of exhaust oxygen. The oxygen is frequently sensed using a solid state electrochemical cell employing zirconia as the electrolyte. Such a zirconia probe produces an electric voltage in the range of approximately 30 mv–1000 mv (millivolts) dependent on the concentration of oxygen in the exhaust gases. The accuracy of the air-fuel control is therefore dependent on the accuracy of the voltage produced by the zirconia sensor relative to the air-fuel ratio.

A problem arises in that the characteristic sensor output curve is influenced by aging of the zirconia sensor due to conditions in the exhaust as well as being dependent upon temperature conditions. Reference is had to the Society of Automotive Engineer's technical paper 800017 entitled "Three Years Field Experience with the Lambda-Sensor In Automotive Control Systems" published on Feb. 25, 1980. Thus, a control system which uses a predetermined set point voltage for control of a specific air-fuel ratio would later provide a different air-fuel ratio for the same set point voltage due to a shift of the characteristic output curve.

As an example in control systems utilizing the sensing of exhaust emissions as a part of a feedback loop, the following is of interest.

U.S. Pat. No. 4,120,269 which issued in the name of Fujishiro on Oct. 17, 1978 discloses in FIG. 3 a reference signal taken as a ratio of a voltage stored across the capacitor in the compensation of a zirconia probe.

U.S. Pat. No. 4,131,089 which issued in the name of Fujishiro et al on Dec. 26, 1978 discloses in FIG. 4 and in column 4 a limitation on the swing of a reference voltage for compensation in characteristics of a zirconia probe.

U.S. Pat. No. 4,142,482 which issued in the name of Asano et al on Mar. 6, 1979 similarly shows a circuit (item 12 in FIGS. 1 and 4) for the limitation on the swing of a reference voltage in the compensation for shift in an automotive exhaust sensor.

U.S. Pat. No. 4,167,925 which issued in the name of Hosaka et al on Sept. 18, 1979 employs circuitry for the compensation of variation in the gas sensor based on maximum swings in the sensor voltage as disclosed in FIGS. 3 and 4.

U.S. Pat. No. 4,170,965 which issued in the name of Aono on Oct. 16, 1979 discloses a mean value circuit (FIG. 4 and Column 4) wherein a capacitor stores a mean value of exhaust sensor, a ratio circuit coupled thereto providing a reference signal for use in compensation in exhaust sensor.

U.S. Pat. No. 4,203,394 which issued in the name of Anono et al on May 29, 1980 discloses an averaging circuit (item 18 in FIG. 2 and bottom of Column 2) to compensate for fluctuations in sensor output.

The above patents disclose emission control systems which rely on controlled perturbations or oscillations of the air-fuel ratio. The present invention does not have nor require such perturbations. Pollutants, such as CO and especially $NO_x$ are easier to control in the present invention. This is particularly true in a steady-state, lower RPM engine operating environment in a non-perturbating system.

In addition, the following U.S. patents are of general interest in this area: U.S. Pat. Nos. 4,177,770; 4,177,787; 4,121,548; 4,117,815; 4,019,474; and 3,984,976. Reference is also made to a U.S. copending patent application assigned to the same assignee as this application entitled "Method and Means For Controlling Air-to-Fuel Ratio", By Kenneth R. Burns and John J. Early; Ser. No. 433,199; filed on Oct. 7, 1982. This copending application and the other patents and publications cited herein are incorporated by reference in their entirety in this application.

SUMMARY OF THE INVENTION

The aforementioned problems are overcome and other advantages are provided by an air-fuel control system employing a zirconia probe, the system employing an automatic calibration procedure in accordance with the invention to compensate for drift in the zirconia sensor output voltage particularly as a function of aging. The system also provides for a warm-up procedure during which the zirconia probe is allowed to warm up in the engine exhaust port to reach a stable temperature for stable output voltage prior to calibration. It is a major object of the invention to provide electrical compensation for the aging of the zirconia sensor.

The invention employs a microprocessor connected to air-fuel mixture means such as mixing valve and to the zirconia sensor probe which are mounted on an engine. At designated times during operation of the engine, a calibration of the control system is implemented by use of the oxidant-fuel mixture means. The valving is operated to vary and maintain the output of the sensor in the region of the calculated set point voltage in accordance with a prescribed routine during which routine the voltage output of the zirconia sensor is monitored.

The invention recognizes that the zirconia sensor voltage versus the air-fuel ratio follows a prescribed functional relationship which may be portrayed graphically as a curve. The curve shifts in position during aging resulting in a reduced output voltage for a given air-fuel ratio condition.

One factor which is to be considered in utilization of the foregoing curve is the rapid drop in output voltage which occurs as the air-fuel ratio passes the stoichiometric value wherein the air-fuel ratio is equal to unity. Thus, the output voltage of the zirconia probe is seen to drop rapidly as the air-fuel ratio passes from rich to lean. The term "Rich" means that there is fuel in excess of that needed for stoichiometric condition while the term "lean" means that there is fuel deficiency relative to that needed for stoichiometric condition.

The curve provides for a very fine resolution of values of the air-fuel ratio in that a relatively large change in voltage occurs for a relatively small shift in the air-fuel ratio. Thus, the invention is particularly useful in situations wherein it is desired to control the air-fuel ratio in the vicinity of the stoichiometric value. In particular, the invention finds use for operation slightly to the rich side of the stoichiometric value, and accordingly, the preferred embodiment of the invention will be described with reference to a control system which maintains the air-fuel ratio to the rich side of the stoichiometric value.

In one embodiment, during each system calibration run wherein the air-fuel mixing valve is run from slightly rich to richer operation, the top of the voltage curve is determined by a minimum differential value in the measured voltage. Thereupon, the control system backs off by a previously determined amount to bring the system operation to the desired set point voltage on the curve which corresponds to the desired air-fuel condition and is substantially independent of any aging of the zirconia sensor. The aging is compensated for by the determination as to the location of the top of the curve, and by a variation in the amount of back-off from the top of the curve. Both of these features are determined by the nature of the curve, taking into account such variations as occur by virtue of the aging process. Thereby, the desired air-fuel ratio is maintained independently of aging of the sensor.

BRIEF DESCRIPTION OF THE DRAWINGS

The foregoing aspect and other features of the invention are explained in the following description, taken in connection with the accompanying drawing wherein.

DETAILED DESCRIPTION

Figure 1:
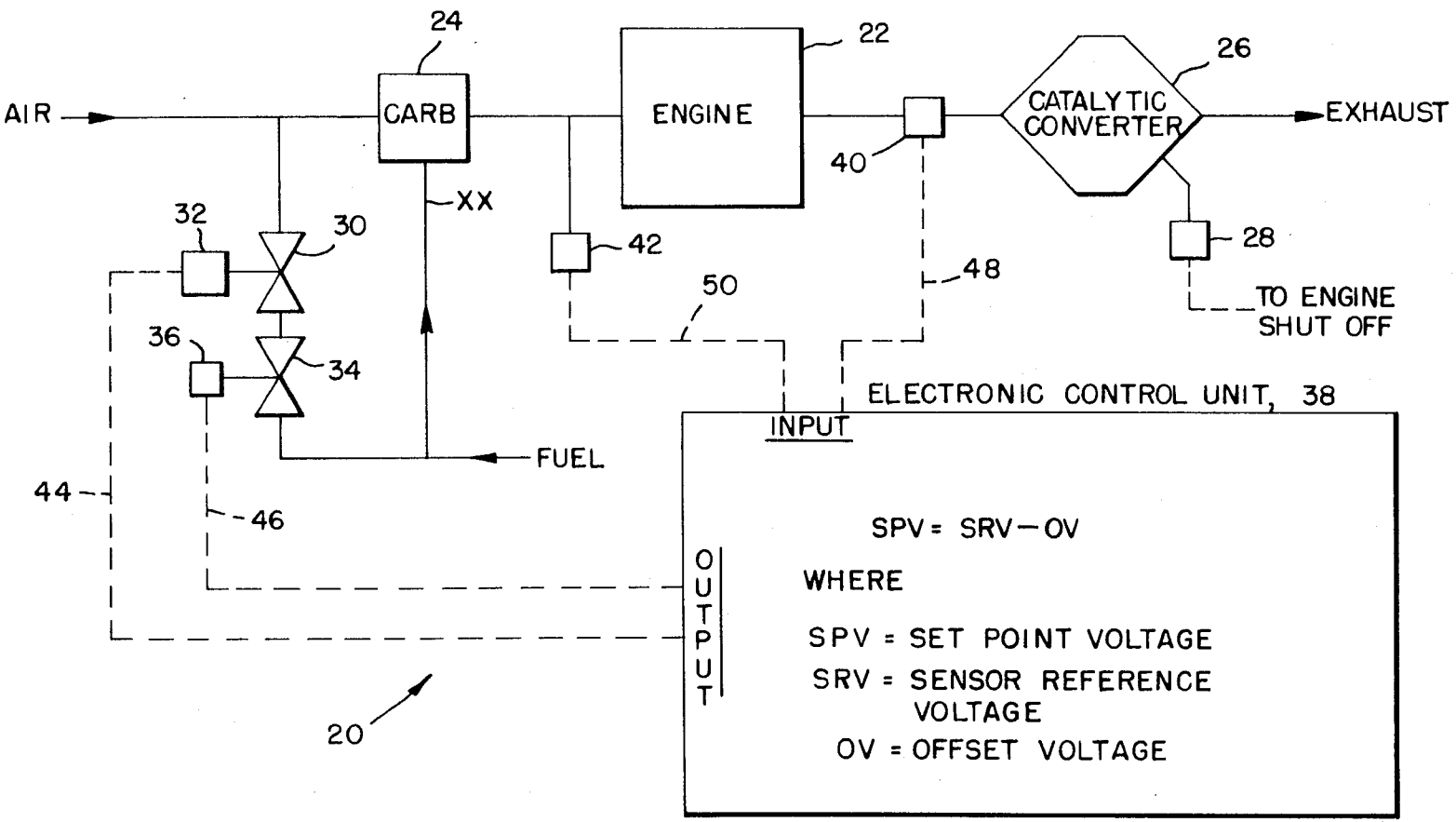
FIG. 1 is a block diagram of a system incorporating the invention for maintaining the air-fuel ratio to an engine at a prescribed value.

With reference to FIG. 1, there is shown a system 20 which incorporates the invention for control of an engine 22. The engine 22 may be an Otto cycle engine burning such as a propane, natural gas, digester gas, landfill gas, gasoline, alcohol, etc. In the exemplary situation shown in FIG. 1, the engine 22 receives its fuel and its air via a carburetor 24, and the exhaust gases are emitted via a catalytic converter 26. The converter 26 is protected against excessively high temperatures by an over-temperature switch 28 which is coupled electrically to an engine shut-off circuit (not shown) of conventional design, as by shutting off the fuel.

Two fuel lines are provided to supply fuel to carburetor 24, a direct line XX and line YY which admits fuel under control unit 38. The carburetor 24 must be adjusted so as to provide a lean air-fuel mixture to the engine when no fuel is being added via line YY. Thus, the fuel being added by line YY allows the air-fuel ratio to be varied from a lean to a rich condition.

The system 20 further comprises a valve 30 which is incrementally opened and closed by a motor 32 for adjustment of the amount of fuel which is to be mixed with the air by the carburetor 24. The motor 32 may be a stepping motor so as to permit operation of the valve 30 by a sequence of steps. Also provided is a valve 34 connected in series with the valve 30 and operated by a solenoid 36 for shutting off the flow of fuel when the engine 22 is not in use. An electronic control unit 38 provides a signal for the control of the operation of the valve 30 and 34, and is responsive to signals received from an exhaust gas sensor 40 and a vacuum 42. The sensor 40 is placed in the exhaust gas line between the output port of the engine 22 and the input port of the catalytic converter 26 for sensing concentration of a specified gas within the engine exhaust, Optionally, the sensor may be placed into the effluent stream of the catalytic converter 26.

In the preferred embodiments of the invention, the sensor 40 is a zirconia probe for determination of the oxygen content of the exhaust. The vacuum switch 42 connects with the junction of the output port of the carburetor 24 and the intake manifold of the engine 22 for sensing the intake vacuum, such vacuum being an indication that the engine 22 is in operation. Termination of the vacuum indicates that the engine 22 has been shut down.

Electrical lines 44 and 46 connect, respectively, the motor 32 and the solenoid 36 to the control unit 38 whereby the control signals of the unit 38 are applied for operation of the valves 30 and 34. An electric line 48 couples the output voltage of the sensor 40 to the control unit 38, and an electric line 50 couples the vacuum signal from the switch 42 to the control unit 38. Thereby, the unit 38 becomes a part of a feedback arrangement wherein, in response to the sensed concentration of oxygen in the engine exhaust by the sensor 40, the unit 38 provide a signal along line 44 to operate the motor 32 for altering the amount of fuel mixed with air in the carburetor 24 to maintain a desired air-fuel ratio.

Figure 2:
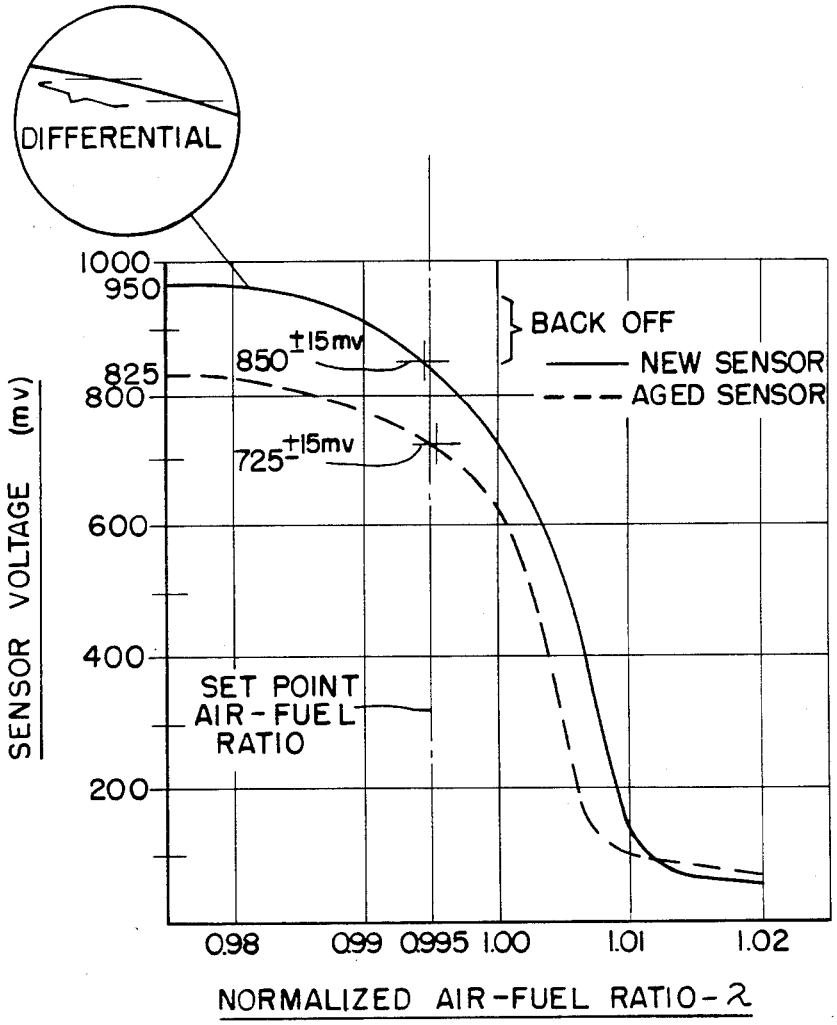
FIG. 2 is graph portraying the relationship of output voltage of a zirconia probe to the air-fuel ratio at the inlet of the engine to FIG. 1.

FIG. 2 shows the relationship of the output voltage of the sensor 40 relative to the normalized air-fuel ratio in which the stoichiometric ratio has been assigned the value 1.00 (unity). The graph of FIG. 2 has a solid trace and a dashed trace representing, respectively, the characteristic curve of a new sensor and the characteristic curve of an aged sensor. The most rapid change in output voltage is as function of the air-fuel ratio is seen to occur in the vicinity of a ratio of unity. For operation at a slightly rich mixture of fuel and air, the output voltage ranges in the illustration depicted in FIG. 2 from approximately 700 mv–900 mv depending on the age of the sensor. It is noted that the curve has shifted with the aging of the sensor 40. Thus, it becomes necessary for the control units 38 (FIG. 1) to compensate for the shifting of the curve with aging of the sensor. The components of the control unit 38 which provide for this function will now be described with reference to FIG. 3.

Figure 3:
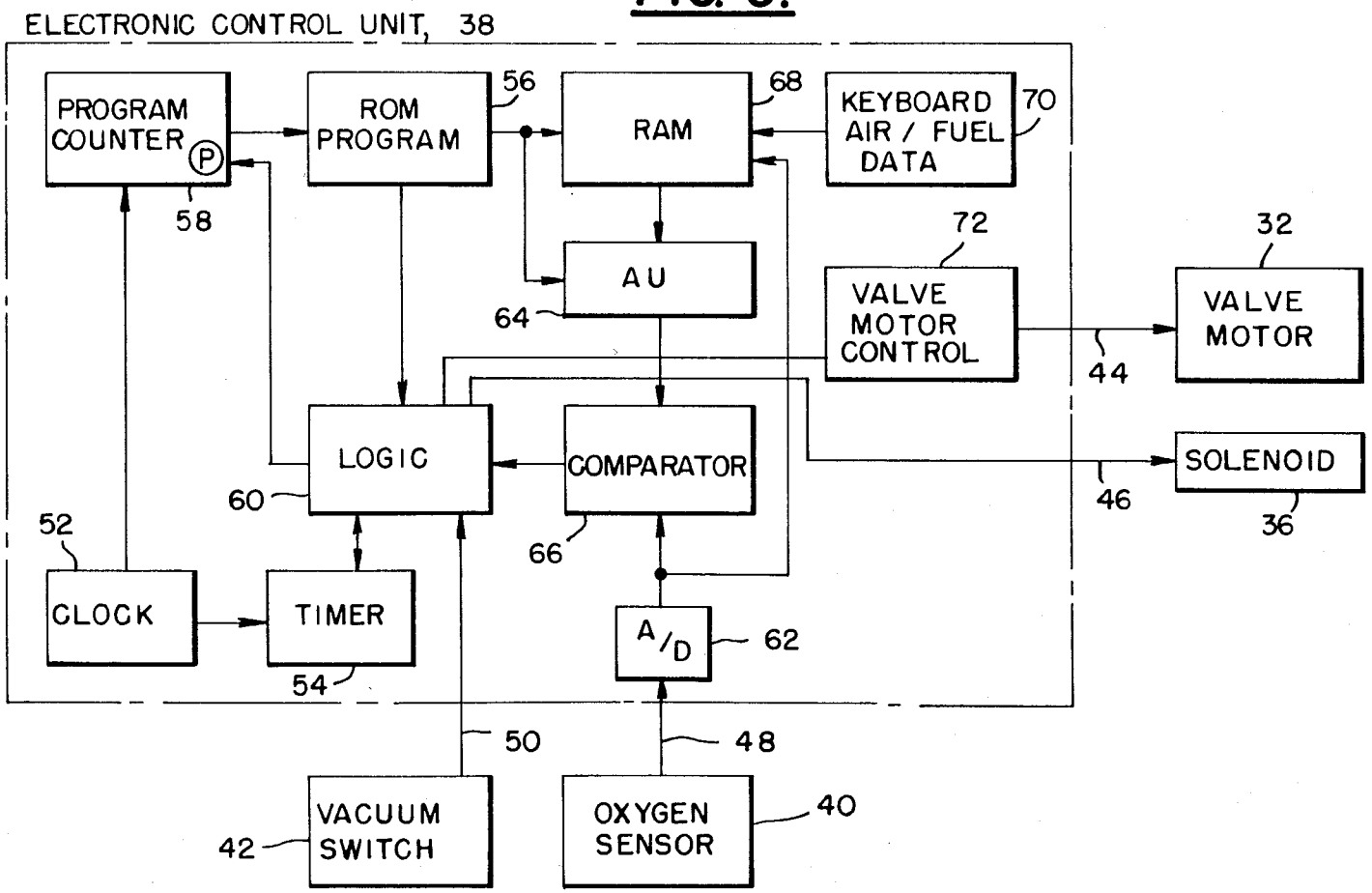
FIG. 3 is a block diagram of an electronic controller unit of FIG. 1.

As shown in FIG. 3, the control unit 38 comprises a clock 52, a timer 54 driven by the clock 52, a read-only memory 56 and a program counter 58 which is driven by the clock 52 and addresses the memory 56. Also provided is a logic unit 60 which receives program instructions from the memory 56 and is responsive to signals of the timer 54 for providing functions which will be described hereinafter.

The control unit 38 further comprises an analog-to-digital converter 62 for converting the analog voltage output of the sensor 40 to a digital word, an arithmetic unit 64, and a comparator 66 which receives output signals of the converter 62 and the arithmetic unit 64. Also included in the unit 38 is a random access memory 68 with a keyboard of entry of data therein, and a motor control unit 72 which is responsive to command signals from the logic unit 60 for generating signals for operation of the valve motor 32.

Figure 4:
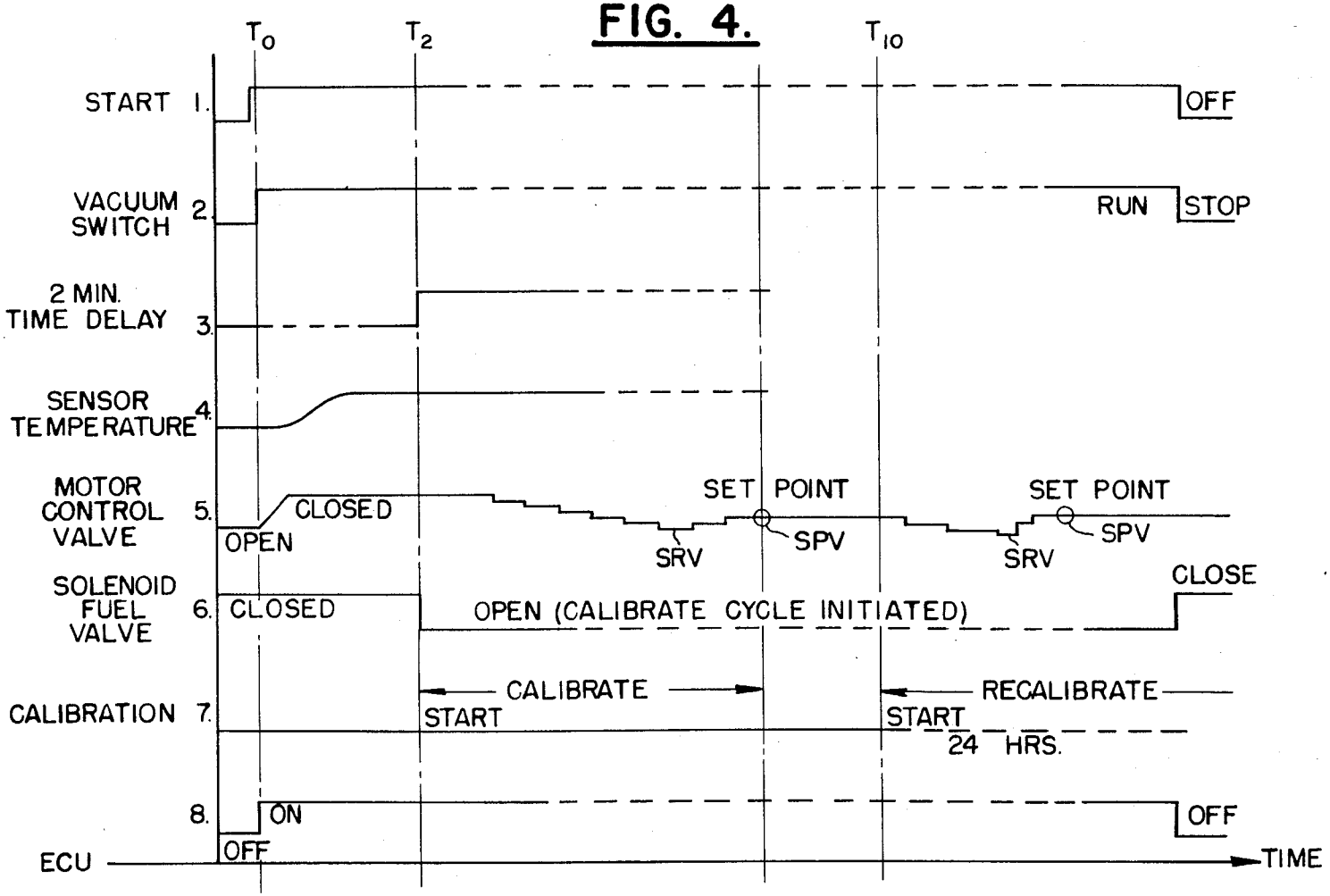
FIG. 4 is timing diagram showing steps in the procedure by which the system of FIG. 1 operates.

With reference also to the timing diagram of FIG. 4, the process for utilization of the system 20 (FIG. 1) begins with the starting of the engine 22 as indicated in the first line of the graph. Typically, this is accomplished with an electric starter (not shown) which imparts rotation to the engine shaft and develops a vacuum in the inlet from the carburetor 24. Thereupon, the vacuum switch 42 operates, as shown in the second line of the graph, to signal the logic unit 60 that the engine 22 is now in operation. The steps in the procedure for the operation in the system 20 may also be seen by reference to the flow chart of FIGS. 5*a*–5*b*. The logic unit 60 then activates the timer 54 to initiate a two-minute time delay, shown in the third line of the graph, to allow for warm-up of the engine 22 and sensor 40. As is well known, zirconia probes are temperature sensitive and, accordingly, accurate use of the sensor 40 can be obtained only after operating at sufficiently elevated temperature is in the engine exhaust. Otherwise, still further compensation circuitry might be utilized to compensate for the temperature dependent variation in the output voltage of the sensor 40, which circuitry would increase the complexity of the system 20. The warming up of the sensor during the two-minute time delay is depicted in the fourth line of the graph in FIG. 4.

The next step in the operation of the system 20 is to provide for a system calibration in response to the characteristic output curve of the sensor 40. This is accomplished by first closing the motorized valve 30 as depicted in the fifth line of the graph whereupon both the valve 30 and the solenoid valve 34 (fixed line of the graph) are closed. In this mode, fuel is solely supplied to the carburetor via line XX. At the end of the two-minute time delay, the logic unit 60 operates the solenoid 36 to open the valve 34 as shown in the sixth line of the graph. The fuel supply line YY is now opened for admitting fuel via the valve 30 to the carburetor 24 and, accordingly, characteristic of the response of sensor 40 by variation of the air-fuel ratio can now begin and be repeated as depicted in the seventh line of the graph. Also, the electronic control unit 38 has been activated in response to the operation of the vacuum switch 42 at the time of the starting of the engine.

As the control unit 38 initiates the calibration process, the motorized valve 30 begins to open slowly increment-by-increment. Each increment occurs on the pulsing of the motor 32 by the control unit 72 which, in turn, is activated by signals from the logic unit 60. The incremental opening of the valve 30 continues, as depicted in line 7 of the graph, until the amount of fuel being mixed with the air is sufficiently large to provide a rich mixture in the engine 22.

The components of the control unit 38, as depicted in FIG. 3, are generally found in commercially available microprocessors. Thus, many of the steps in the operation of the system 20 can be accomplished by suitably programming a microprocessor. Thus, in the opening of the valve 30 until an overly rich mixture is attained, this corresponding to the left-hand portion of the curves in FIG. 2, the control unit 38 determines that the upper left-hand portion of the curve of FIG. 2 has been attained by successive observations of the sensor voltage. When the voltage is seen to equal or vary by less than a predetermined amount, a determination is made that the air-fuel ratio now corresponds to the upper left portion of the graph of FIG. 2. The value of this predetermined amount can, for example, be about 1 to 10 mv, and preferably less than approximately 3 mv, depending upon the degree of signal dampening utilized. With respect to FIG. 3, the output of the converter 62 is also connected to the memory 68 which provides for the storing of a previous value of the sensor output. Thereby, a present and previous value can be compared at the comparator 66. The instructions of the program stored within the memory 56 activate the arithmetic unit 64 to couple the previously stored value of sensor voltage from memory 68 to the comparator 66. When such comparison is less than the aforementioned amount, the logic unit 60 presets the program counter 58 to the next stage of the calibration procedure.

The next stage is accomplished by retracting the air-fuel ratio towards a leaner value as indicated by the set pointer in FIG. 2. This is accomplished by incrementally closing the valve 30 so as to reduce the amount of fuel being fed to the carburetor 24. The closure of the valve is depicted in the fifth line of the graph in FIG. 4, the graph showing that upon attainment of the set point voltage, the setting of the valve 30 is thereafter retained until such time as recalibration is to be instituted.

In accordance with an important feature of the invention, the amount of closure of the valve 30 for reaching the set point is attached with the aid of a mathematical calculation set forth in FIG. 1. The relationship shown in FIG. 1 is in terms of output voltages of the sensor 40. The set point voltage, indicated as SPV in FIG. 1, is the magnitude of the voltage corresponding to the air-fuel ratio at the set point. The sensor reference voltage, indicated as SRV in FIG. 1, is the magnitude of the nominal maximum sensor voltage at the foregoing maximum opening of the valve 30, just prior to retraction of the valve 30, this being indicated by the legend SRV in the fifth line of FIG. 4. It is noted that the SRV will vary with aging of the sensor 40 in accordance with the previous description of the curves of FIG. 2.

The SRV will change as a function of the age and the operating temperature of the sensor 40. The foregoing two terms appear in the mathematical relationship set forth in FIG. 1. In addition, a third term, as being an off-set voltage (OV) also appears in the relationship. The offset voltage (OV) can be a constant or, alternatively, can vary as a function of the value of the SRV.

The sensor reference voltage (SRV) can be any suitable voltage. For instance, it can be a nominal maximum output voltage of the sensor, as described in conjunction with FIG. 2. Alternatively, it can be a nominal minimum output voltage of the sensor.

From the foregoing mathematical relationship, it becomes apparent that the amount of backoff or offset voltage from the maximum opening of the valve 30 varies with aging of the sensor 40. In addition, it is noted that the determination of the sensor reference voltage (SRV) is based, not on a single measurement of the sensor voltage under conditions of a rich air-fuel ratio, but, rather, is based on a differential measurement in accordance with the foregoing description wherein two successive measurements of the sensor voltage differed by less than a predetermined amount. Thus, the SRV is actually measured at a point wherein the differential of the graph of FIG. 2 is less than a predetermined amount. Thereby, it is seen that the procedure for backing off the valve 30 to a leaner air-fuel ratio is based on both the measurement of a differential and on the subtraction of an offset voltage.

The foregoing calculation for the backing off of the valve 30 is attained by use of the arithmetic unit 64 in FIG. 3. Under instructions, the program stored in the memory 56, the arithmetic unit 64 receives the necessary data from the memory 68 and performs the calculation set forth in FIG. 1. The resultant number produced by the arithmetic unit 64 is thus the set point voltage (SPV) which number is available to the comparator 66. Thereby, during subsequent operation of the engine 22, the output voltage of the sensor 40, as presented by the converter 62, is compared against the SPV of the unit 64 by the comparator 66. The output signal of the comparator 66 then signals the logic unit 60 to request a richer or leaner fuel mix by directing the motor control unit 72 to operate the motor 32 for changing the setting of the valve 30.

Figure 5D:
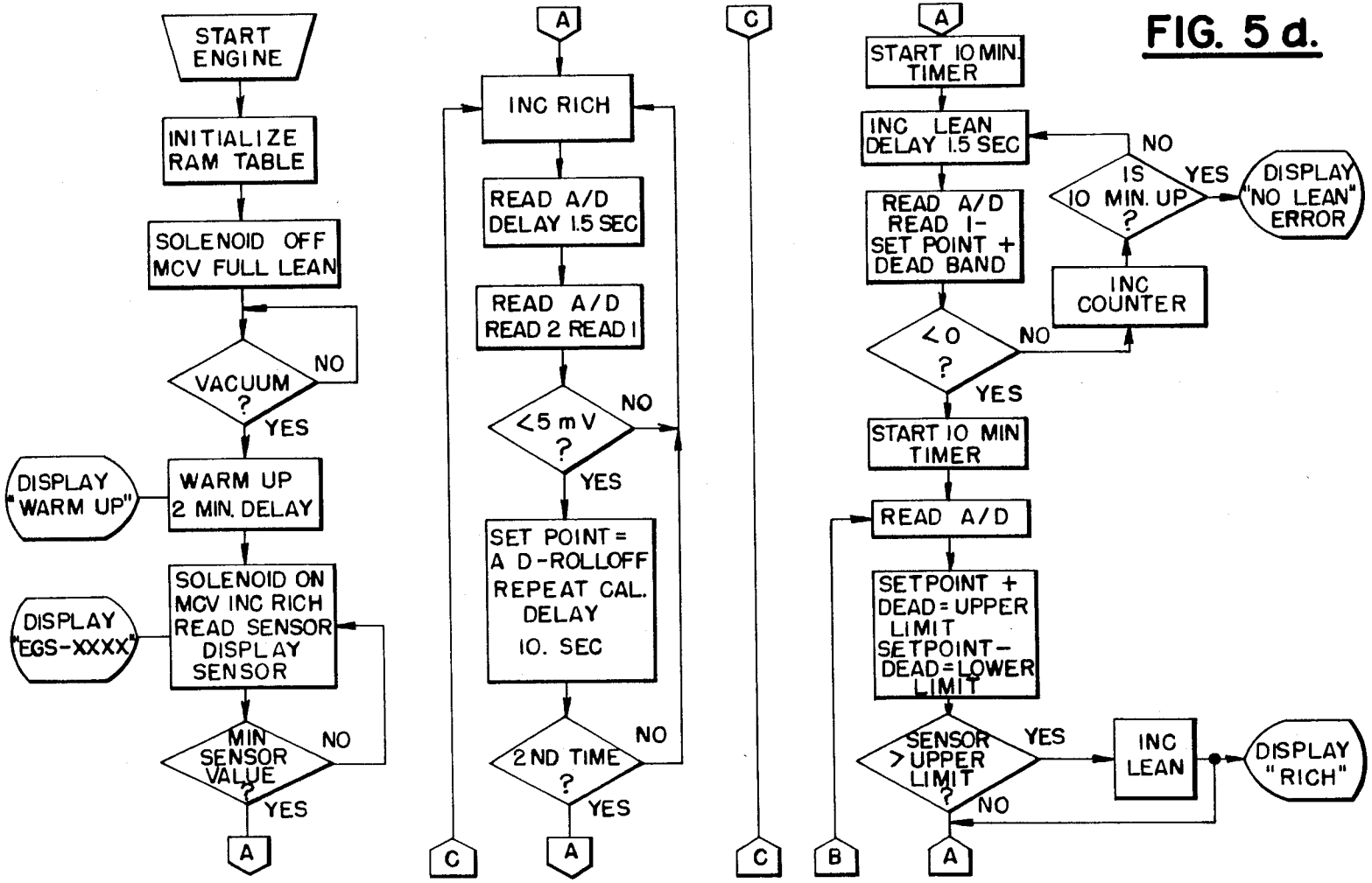
FIGS. 5*a* and 5*b* taken together constitute a flow chart depicting a typical program for operation of a microprocessor in the system of FIG. 1.
Figure 5B:
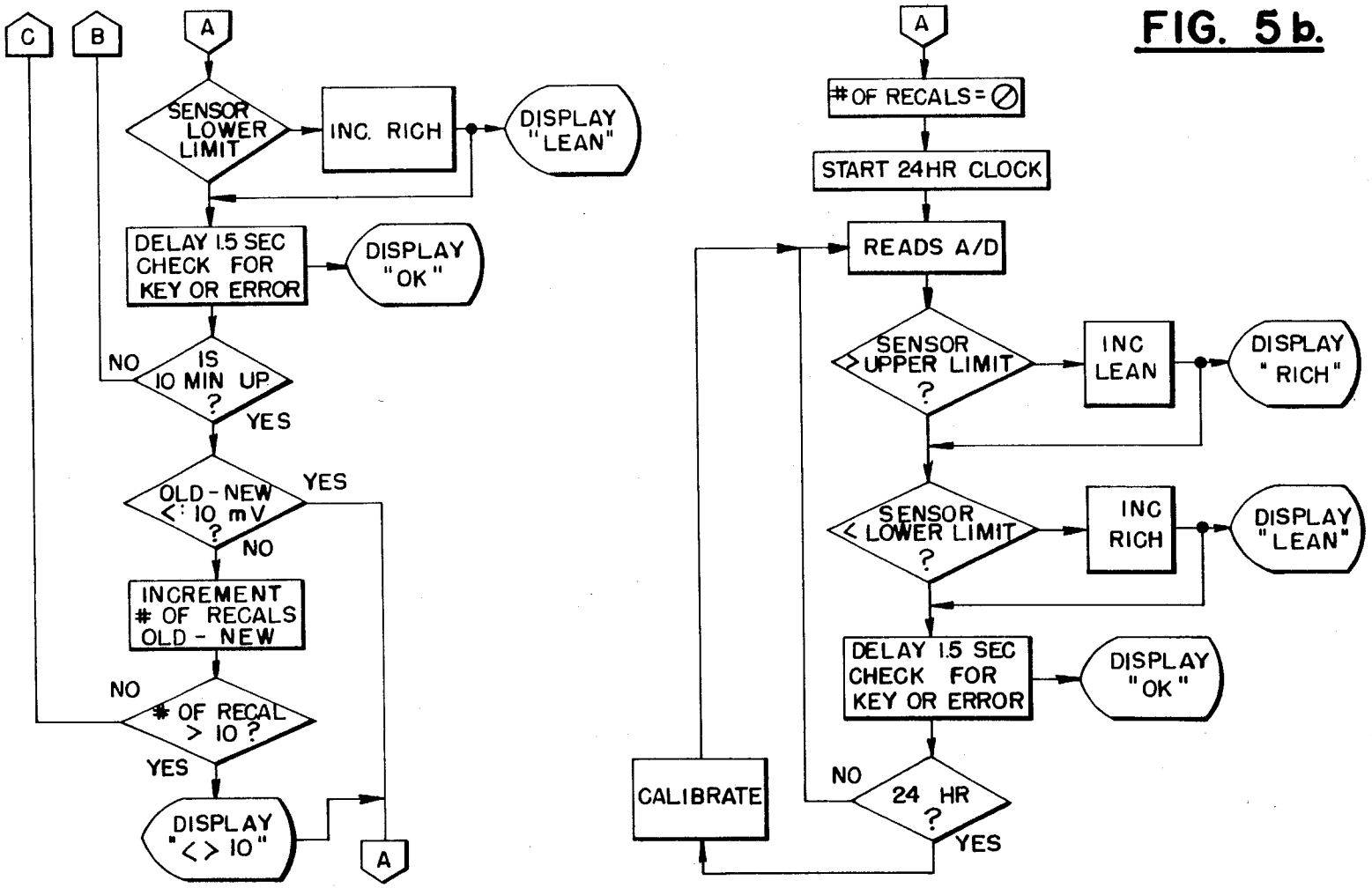

As indicated in the fifth line of the graph of FIG. 4, as well as in the program flow chart of FIGS. 5*a*–5*b*, a recalibration procedure is implemented by operation of the valve 30. The succession of steps in opening and closing the valve 30 follows that set forth during the original calibration run. There can also be a recalibration after a suitable time, such as two minutes, in the engine 22. The recalibration is to verify that, in fact, the sensor 40 is operating at the calculated set point. Thereafter, the engine 22 may be run continuously without recalibration for a period such as 24 hours, after which a recalibration run is again instituted. The timer 54 provides for the measurement of the two-minute interval and the 24-hour interval. Alternatively, the initial calibration and subsequent recalibrations can be initiated manually by an operator.

For illustration purposes, the values of the sensor voltages at the set point voltage and the sensor reference voltage may be as follows with reference to FIG. 2. The SPV for a new sensor is approximately 850 mv, the value having a suitable operating tolerance such as ±15 mv, for an air-fuel ratio of 0.995. For an aged sensor, a value of approximately 725 mv is obtained for an air-fuel ratio of 0.995. The SRV has the value of approximately 950 mv for the new sensor and a value of 825 mv for the aged sensor. The offset voltage is a constant in this illustration with a value of approximately 100 mv. As shown in FIG. 2, the set point voltages are provided with approximate tolerances such that operation at a set point voltage means that the actual set point voltage is within a limited region, the limits being the tolerance permitted.

Thereby, the system 20 has provided a procedure for the control of the air-fuel ratio of an engine, and has, furthermore, provided for a calibration procedure which insures a proper reference point which is updated in accordance with the aging of the exhaust gas sensor. Thereby, variations in the parameters of the sensor are compensated so as to insure precise and accurate control of the air-fuel ratio throughout the life time of the sensor.

Several alternatives are possible in utilizing the method described herein and are intended to be incorporated herein. For instance, one embodiment herein is to adjust the fuel valve in one direction such as to run the system richer to vary the air-fuel ratio. Once a nominal maximum voltage of the sensor or sensor reference voltage is determined and the set point calculated, the fuel valve is operated in the opposite direction such as to run the system leaner to bring the system back to and maintain it within the region of the calculated set point voltage.

A similar procedure may be carried out using a nominal minimum voltage of the sensor instead of a nominal maximum voltage for the sensor reference voltage. In this case, the fuel valve can be adjusted in a first direction such as to run the system leaner. After a nominal minimum sensor voltage is determined and the set point calculated, the fuel valve can be operated in the opposite direction such as to run the system richer to bring it back and maintain it within the region of the calculated set voltage. In this case, the set point voltage value would result from adding an offset voltage to the nominal minimum sensor reference voltage (similar to the back off voltage in the prior embodiment). It may be necessary in this embodiment to add an additional air line to the carbaretor.

It is to be understood that the above described embodiments of the invention is illustrative only and that modifications thereof may occur to those skilled in the art. Accordingly, this invention is not to be regarded as limited to the embodiment disclosed herein, but it is to be limited only as defined by the appended claims.

What is claimed is:

1. In a system having an oxidant-fuel mixture means for control of the oxidant-fuel ratio in an engine burning fuel with an oxidant by use of a sensor of said ratio, a method for controlling said ratio independently of aging of said sensor, said method comprising the steps of:

operating an oxidant-fuel mixture means to vary the oxidant-fuel ratio to increase the richness of the oxidant-fuel mixture, sensing the richness of the mixture with a sensor providing a signal indicative of said ratio, said step of sensing being repeated to provide a succession of said signals;

determining the differential between successive ones of said signals from each other to obtain a differential signal;

storing the value of the sensor signal when the differential signal is equal to or less than a predetermined amount, said stored value being designated a sensor reference voltage;

calculating a set point voltage for desired oxidant-fuel ratio based on values of the sensor reference voltage; and operating the oxidant-fuel mixture means to maintain the output of the sensor in the region of the calculated set point voltage.

2. A method according to claim 1 wherein initiation of the varying of the ratio is carried out manually.

3. A method according to claim 1 wherein initiation of the varying of the ratio is carried out automatically.

4. A method according to claim 1 wherein the predetermined amount varies from said signals by less than approximately 3 mv.

5. A method according to claim 1 wherein the region surrounding the calculated set point voltage is approximately ±15 mv.

6. A method according to claim 1 wherein said oxidant is air.

7. A method according to claim 6 wherein said sensor senses the presence of oxygen in the exhaust emissions of said engine.

8. A method according to claim 7 wherein said sensor is fabricated of zirconia.

9. A method according to claim 6 wherein said fuel is a gaseous hydrocarbon selected from the group consisting of propane, natural gas, digester gas and landfill gas and mixtures thereof.

10. A method according to claim 6 wherein the fuel is a liquid hydrocarbon selected from the group consisting of gasoline, alcohol and mixtures thereof.

11. In a system having an oxidant-fuel mixture means for the control of the oxidant-fuel ratio in a engine burning fuel with an oxidant by use of a sensor of said ratio, a method for controlling said ratio independently of aging of said sensor, said method comprising the steps of:

adjusting an oxidant-fuel mixture means in one direction to vary the oxidant-fuel ratio through a region of values wherein said sensor provides a signal which substantially varies with changes in said ratio;

sensing said ratio with said sensor during variation of said ratio, said sensor providing a succession of signals during said sensing;

determining the differential between successive ones of said signals from each other to obtain a differential signal;

storing the value of the sensor signal when the differential signal equals or is less than a predetermined amount, said stored value being designated as a sensor reference voltage;

calculating a set point voltage based on values of said sensor reference voltage, and operating said oxidant-fuel mixture means in the opposite direction to maintain the output of the sensor in the region of the calculated set point voltage.

12. A method according to claim 11 wherein the predetermined amount is less than approximately 3 mv.

13. A method according to claim 11 wherein the region surrounding the calculated set point voltage is approximately ±15 mv.

14. A method according to claim 11 wherein said adjusting of said oxidant-fuel mixture means involves operating the system to increase the richness of the oxidant-fuel mixture.

15. A method according to claim 11 wherein the adjusting of said oxidant-fuel mixture means involves operating the system to decrease the richness of the fuel mixture.

16. A method according to claim 11 wherein said oxidant is air.

17. A method according to claim 11 wherein the mixture means is a fuel valve and said step of operating the fuel valve constitutes an opening of the fuel valve to increase the richness of the oxidant-fuel mixture, said sensing is accomplished by sensing the amount of oxygen in the exhaust emissions from said engine, and the storing of the value of the sensor signal is accomplished when the differential signal is equal to or less than the approximately 3 mv.

18. A method according to claim 17 wherein said differential signal is obtained for a rich value of oxidant-fuel ratio.

19. The method according to claim 16 wherein said fuel is gaseous hydrocarbon selected from the group consisting of propane, natural gas, digester gas and landfill gas and mixtures thereof.

20. The method according to claim 16 wherein the fuel is a liquid hydrocarbon selected from the group consisting of gasoline, alcohol and mixtures thereof.

* * * * *